United States Patent [19]

Kallianos et al.

[11] Patent Number: 4,677,995

[45] Date of Patent: Jul. 7, 1987

[54] FILTER CIGARETTE

[75] Inventors: Andrew G. Kallianos, Midlothian; Francis M. Sprinkel, Jr., Glen Allen; Paula Decker, Petersburg, all of Va.

[73] Assignee: Philip Morris Incorporated, New York, N.Y.

[21] Appl. No.: 831,837

[22] Filed: Feb. 24, 1986

[51] Int. Cl.[4] ..... A24D 3/04; A24D 3/06; A24D 3/18

[52] U.S. Cl. ..... 131/335; 131/336; 131/338; 131/339

[58] Field of Search ..... 131/335, 338, 339, 340, 131/198.2, 198.1, 336

[56] References Cited

U.S. PATENT DOCUMENTS

| | | | |
|---|---|---|---|
| 2,954,035 | 9/1960 | Saffir . | |
| 3,016,902 | 1/1962 | Lipp et al. . | |
| 3,359,988 | 12/1967 | Thomson . | |
| 3,428,050 | 2/1969 | Kandel . | |
| 3,463,166 | 8/1969 | Bennett et al. . | |
| 3,515,146 | 6/1970 | Nealis . | |
| 3,596,665 | 8/1971 | Lindgard . | |
| 4,532,943 | 8/1985 | Nichols et al. | 131/336 |
| 4,593,707 | 6/1986 | Seidel et al. | 131/338 |

FOREIGN PATENT DOCUMENTS

| | | |
|---|---|---|
| 0105682 | 4/1984 | European Pat. Off. . |
| 1058343 | 2/1967 | United Kingdom . |
| 1095848 | 12/1967 | United Kingdom . |

*Primary Examiner*—V. Millin

*Attorney, Agent, or Firm*—Jeffrey H. Ingerman

[57] ABSTRACT

A filter cigarette is provided in which the smoker can select varying levels of one or more flavorants to be added to the smoke stream. A rotatable filter segment having several smoke flow paths, each containing a different flavorant material, cooperates with a baffle to select one or more paths through which the smoke stream will travel.

12 Claims, 6 Drawing Figures

FILTER CIGARETTE

BACKGROUND OF THE INVENTION

This invention relates to filter cigarettes. More particularly, this invention relates to filter cigarettes of the type in which the smoker can control the addition of flavorants to the smoke stream.

It is known to produce filter cigarettes having rotatable or axially movable elements, particularly in association with the filter assembly of the cigarette, for controlling one or more smoking characteristics of the cigarette. In particular, commonly-assigned U.S. Pat. No. 4,532,943 shows a cigarette in which the filter has two relatively rotatable segments which can be used to control one or more of the air dilution value, the resistance-to-draw, and the amount of added flavorant in the smoke stream, of the cigarette. Copending, commonly-assigned U.S. patent application Ser. No. 640,589, filed Aug. 14, 1984, shows a filter cigarette having an axially movable filter segment for controlling one or more of the same characteristics. Other cigarettes are known in which the amount of added flavorant can be controlled by the smoker.

However, in the known cigarettes in which the amount of added flavorant can be controlled, the initial condition of the cigarette is one in which no flavorant is added to the smoke stream. Movement of a control element in those cigarettes, whether rotationally, axially, or otherwise, usually ruptures a flavorant capsule or other flavorant-containing element. In some of those cigarettes, increasing movement of the control element ruptures increasing numbers of flavorant-containing elements, so that the smoker can choose the amount of flavorant to add. However, once the flavorant-containing elements have been ruptured, there is no means provided for resealing them to lessen the amount of added flavorant or to completely eliminate it. In addition, because there is no way to control which of the individual flavorant-containing elements are ruptured at a particular time, these cigarettes can only provide a choice of one flavorant.

It would be desirable to be able to provide a filter cigarette in which the smoker could both increase and decrease the amount of flavorant added to the smoke stream. It would also be desirable to be able to provide a filter cigarette in which a smoker could select one or more of a number of flavorants to be be added to the smoke stream.

SUMMARY OF THE INVENTION

It is an object of this invention to provide a filter cigarette in which a smoker can increase or decrease the amount of flavorant added to the smoke stream, including completely eliminating the added flavorant.

It is another object of the invention to provide a filter cigarette in which a smoker can select one or more of a number of flavorants to be added to the smoke stream.

In accordance with the invention, there is provided a filter cigarette having a substantially cylindrical tobacco rod, a substantially cylindrical filter assembly, and tipping paper circumscribing and joining the filter assembly and the tobacco rod. The filter assembly includes a first filter assembly segment having a mouth end, a rod end, and a plurality of smoke flow paths therethrough separated by barriers which are at least substantially smoke-impervious. At least one of the smoke flow paths contains a smoke flavoring medium.

The filter assembly also includes means abutting the first filter assembly segment and rotatable relative thereto for selectively directing smoke through at least one of the smoke flow paths and excluding it from the remainder of the smoke flow paths.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
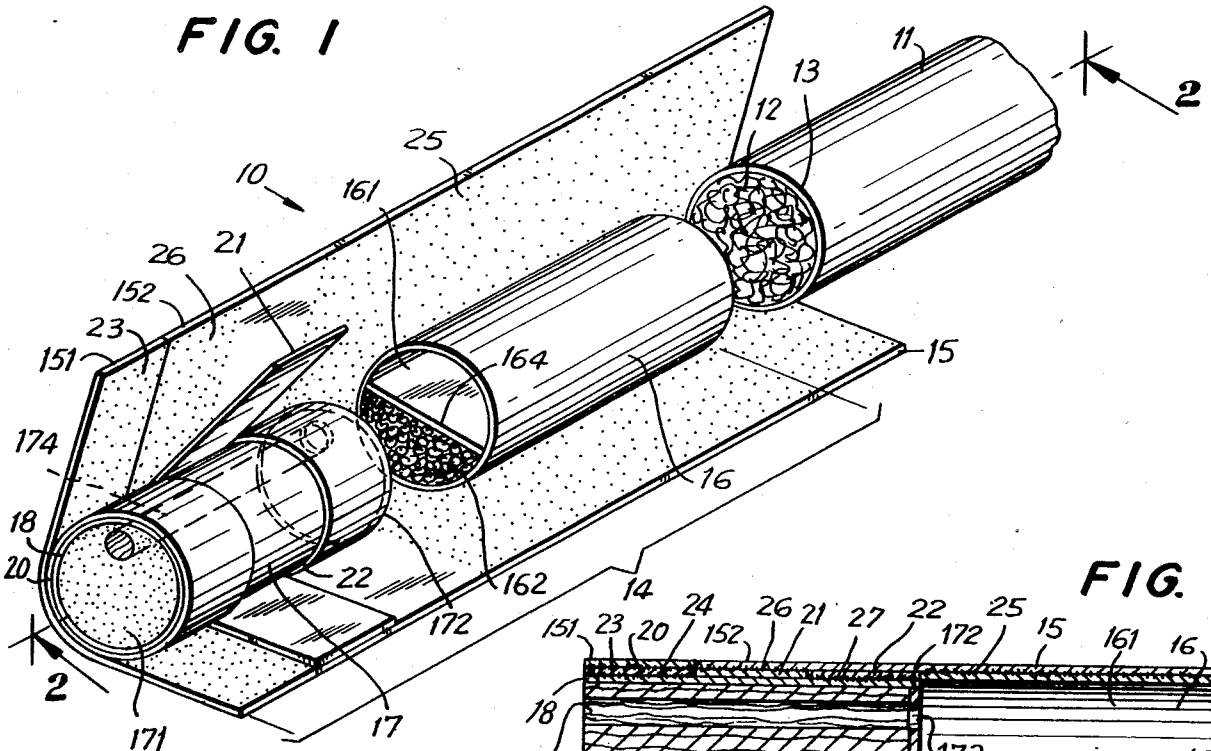
FIG. 1 is a fragmentary, partially exploded perspective view taken from the mouth end of one embodiment of a filter cigarette according to this invention.
Figure 2:
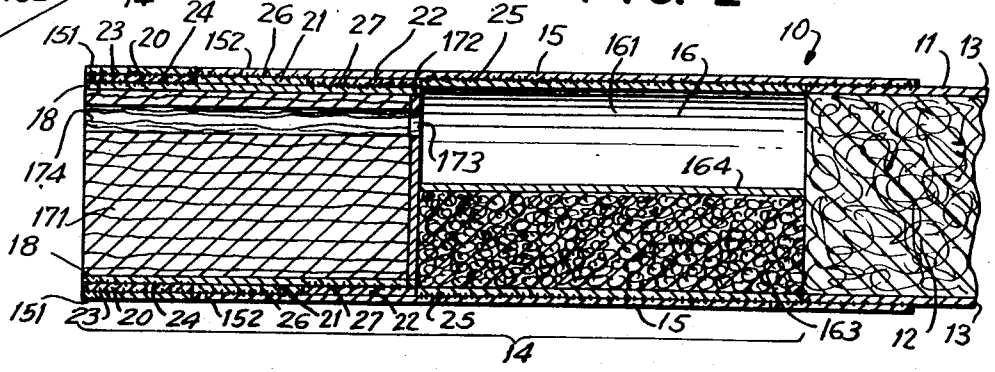
FIG. 2 is a fragmentary, longitudinal cross-sectional view of the cigarette of FIG. 1, taken from line 2—2 of FIG. 1.

A first embodiment 10 of a filter cigarette according to this invention is shown in FIGS. 1 and 2. Cigarette 10 includes a tobacco rod 11—that is, a charge of tobacco 12 wrapped in cigarette paper 13—and a filter assembly 14 circumscribed and joined to tobacco rod 11 by tipping paper 15. Filter assembly 14 includes a first filter assembly segment 16 and a second filter assembly segment 17 abutting, and rotatable relative to, segment 16.

Segment 16 contains two smoke flow paths—or flavor chambers—161, 162. As shown in FIGS. 1 and 2, smoke flow path 161 is empty, and smoke flow path 162 contains a carrier medium 163 impregnated with a flavorant material. The two paths 161, 162 are divided by an at least substantially smoke-impervious barrier 164. Segment 17 is made of filter tow material 171 wrapped in plug wrapping 18 and has at its rod end, abutting segment 16, a smoke-impervious baffle 172 having an opening 173 therein communicating with a longitudinal bore 174 extending from end to end of segment 17.

Segment 17 is circumscribed by first, second and third abutting tipping-type paper bands 20, 21, 22. Segment 17 is in turn, along with segment 16 and a portion of tobacco rod 11, circumscribed by tipping paper 15 which is divided into a mouth-end section 151 and a rod-end section 152. Mouth-end section 151 is coextensive with first band 20 and is adhered thereto by adhesive band 12. Band 20 is in turn adhered to plug wrapping 18 by adhesive band 24. Rod-end section 152 extends from mouth-end section 151 to a point on tobacco rod 11 and is adhered to segment 16 and tobacco rod 11 by adhesive band 25. Second band 21 is adhered only to rod-end section 152 by adhesive band 26, and third band 22 is adhered only to plug wrapping 18 by adhesive band 27. This arrangement of bands and adhesive allows segment 17 to rotate relative to segment 16 while retaining it against axial displacement.

When segment 17 is rotated to the position shown in FIGS. 1 and 2 in which opening 173 and bore 174 are aligned with smoke flow path 161, the smoker obtains the flavor in that path. As shown, path 161 provides unflavored smoke. When opening 173 and bore 174 are aligned with path 162, the flavor in carrier 163 is obtained. If desired, a second flavoring can be provided in path 161 as well. Because smoke can flow directly through bore 174, the smoke in either case is not filtered. If bore 174 were eliminated, the smoke would be filtered as well as being flavored according to the selected smoke flow path.

Figure 3:
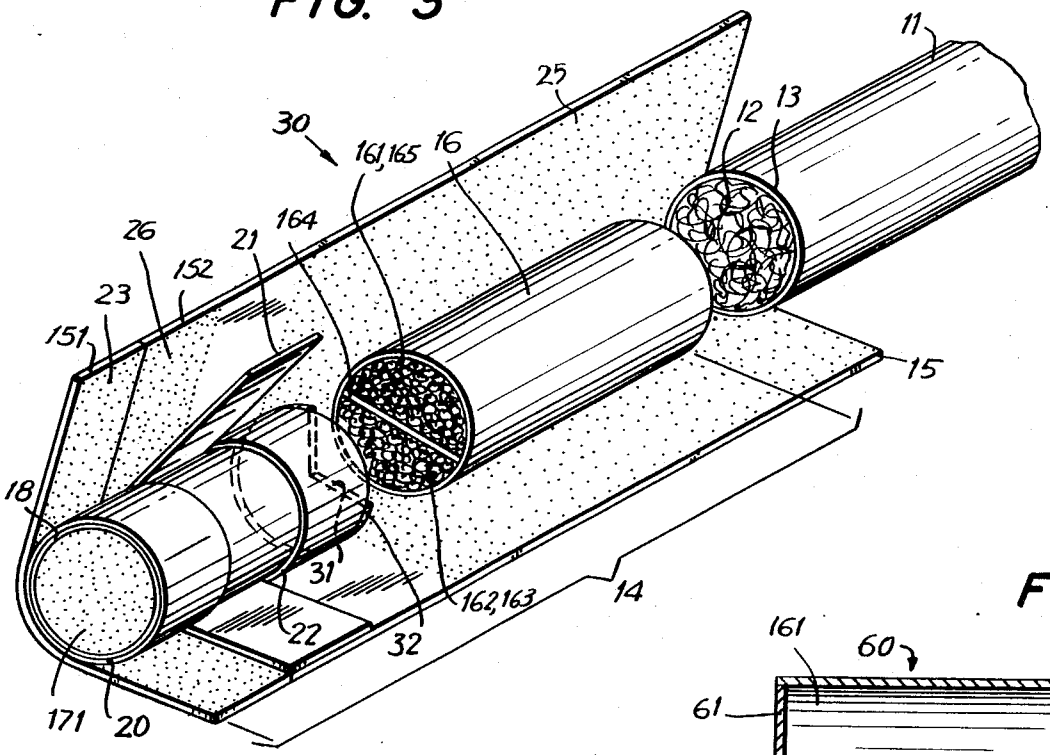
FIG. 3, is a fragmentary, partially exploded perspective view taken from the month end of a second embodiment of a filter cigarette according to this invention.

A second embodiment 30 of a filter cigarette according to the invention is shown in FIG. 3. Cigarette 30 is similar to cigarette 10, except that there is no bore 174 in segment 17, and opening 31 in baffle 32 is a larger, wedge-shaped opening which can be aligned entirely with one smoke flow path or partly with one smoke flow path and partly with another. In addition, as shown in FIG. 3, path 161 includes a flavor carrying medium 165 although it can be omitted as in FIGS. 1 and 2. The smoker of cigarette 30 can thus select one or both of the flavors carried by media 163, 165.

Figure 4:
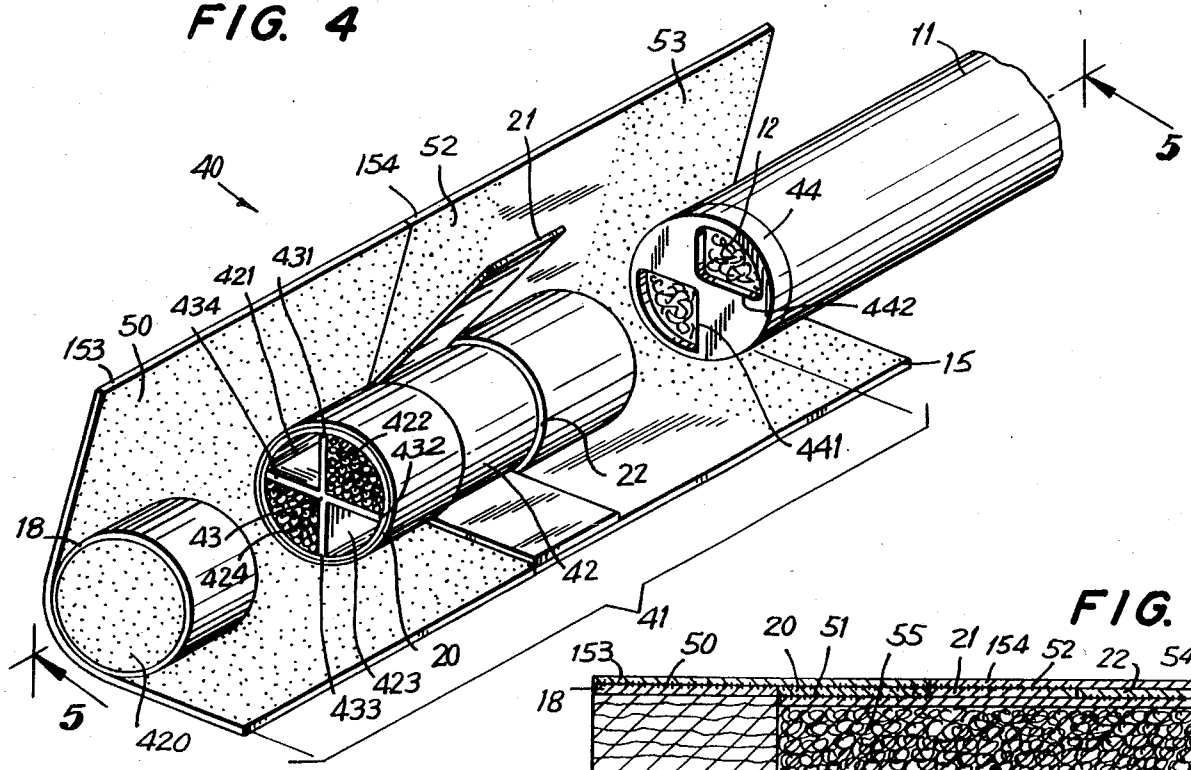
FIG. 4 is a fragmentary, partially exploded perspective view of a third embodiment of a filter cigarette according to this invention.
Figure 5:
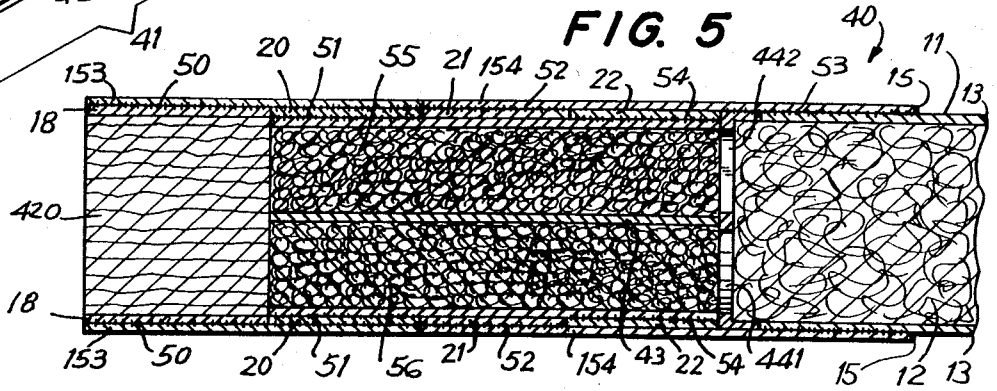
FIG. 5 is a fragmentary, longitudinal cross-sectional view of the cigarette of FIG. 4, taken from line 5—5 of FIG. 4.

In cigarettes 10, 30, the filter assembly segment containing the smoke flow paths is stationary (relative to the tobacco rod), and the abutting relatively rotatable element rotates. Cigarette 40 of FIGS. 4 and 5 shows how a cigarette according to this invention can be provided in which the element containing the smoke flow paths rotates and the abutting relatively rotatable element is stationary (relative to the tobacco rod). Cigarette 40 also shows a cigarette having more than two smoke flow paths.

Cigarette 40 includes tobacco rod 11 and filter assembly 41 circumscribed by tipping paper 15. First filter assembly segment 42 has four smoke flow paths 421, 422, 423, 424 divided by substantially smoke-impervious barriers 431, 432, 433, 434 radiating off central spine 43. A filter tow segment 420 wrapped in plug wrapping 18 is attached to the mouth end of segment 42 to provide a familiar sensation for the smoker's tongue and to provide a degree of filtration. For more complete filtration, a longer filter tow segment can be used. The final element of filter assembly 41 is a baffle 44 attached over the mouth end of tobacco rod 11, abutting segment 42, having two openings 441, 442.

Bands 20, 21, 22 circumscribe segment 42. Tipping paper 15 is divided into mouth-end section 153 and rod-end section 154. Mouth-end section 153 is coextensive with plug wrapping 18, and with band 20 to which it is adhered by adhesive band 50. Band 20 is in turn adhered to segment 42 by adhesive band 51. Rod-end tipping section 154 extends from section 153 to a point on tobacco rod 11, and is adhered to band 21 by adhesive band 52 and to tobacco rod 11 by adhesive band 53. Band 21 is not adhered to segment 42. Band 22 is adhered only to segment 42 by adhesive band 54. This arrangement of bands and adhesive allows segment 42 to rotate relative to baffle 49 while retaining it against axial displacement.

As shown in FIG. 4, paths 421, 423 contain no flavorant, while paths 422, 424 contain flavor carriers 55, 56. Because two paths are selected at once by openings 441, 442, flavor carriers 55, 56 preferably carry the same flavor. However, if baffle 44 is provided with only one opening, then four different flavors can be provided in paths 421–424, including, if desired, one path in which the "flavor" is "no flavor". Another alternative is that different concentrations of the same flavor, including a zero concentration, can be provided in the different paths, so that a smoker can select gradations of flavor.

By selecting the number of paths to be provided, and by including "no-flavor" paths, paths of different flavors, and paths of different concentrations of the same flavor, or combinations of these alternatives, a cigarette can be provided in which flavor can be turned "on" and "off", different flavors or combinations of flavors can be selected, or different levels of one or more flavors can be selected.

Any suitable flavorants can be used in the cigarette of this invention. Flavors such as menthol, which can be added to the smoke stream during the smoking of the entire cigarette, can be used. If menthol is used, the present invention could be used to select menthol or no menthol, or a base level of menthol could be provided in the cigarette, and the present invention would allow the smoker to enhance the level of menthol as desired. Alternatively, flavors which would be overwhelming if added during the smoking of the entire cigarette, but which would be effective as a "last puff freshener", such as anise or orange, might be used. In the latter case, the smoker preferably would be instructed not to select that flavor path until the cigarette were nearly finished. Another possibility is the provision of an activated charcoal path, providing removal of undesirable flavor components.

Charcoal can also be used as a flavor carrier. Other possible flavor carriers which can be used with this invention are calcium hydroxide, magnesium hydroxide, treated cellulosic material such as cellulose acetate or carboxymethylcellulose, polyvinyl acetate emulsions or polyvinyl alcohol emulsions which provide semi-encapsulation, whey by-products, wheat chaff, and capsules that are broken down by physical rupture or by heat, moisture, or other smoke components.

Figure 6:
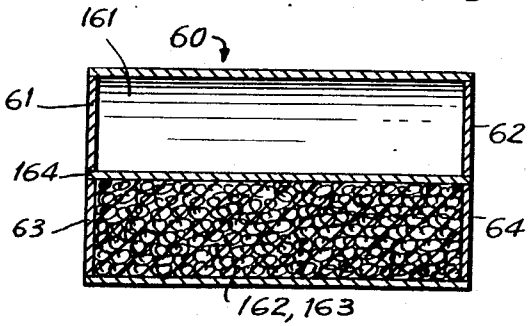
FIG. 6 is a longitudinal cross-sectional view of an alternative embodiment of a filter assembly segment according to this invention.

Some of the flavors that might be used with this invention are sufficiently volatile that they may migrate from the ends of their own respective paths to neighboring paths, contaminating the flavor in those other paths. To prevent such migration, a modification 60 of segment 16 is shown in FIG. 6. Seals 61, 62, 63, 64 are provided at the ends of paths 161, 162. Seals 61–64 can be membranes of plastic, foil or paper which break when segment 60 is rotated for the first time, allowing smoke to pass through. This would prevent flavor migration before a cigarette is smoked, but not during smoking. Alternatively, seals 61–64 could be flaps of resilient material which normally remain closed, but which, under the action of a smoker's draw, deflect to allow the passage of smoke. This would prevent flavor migration even during smoking. A combination of both types of seals could also be used, because the membrane-type seal is more effective over long periods of time, such as those encountered during shipping and on the shelf.

Thus a cigarette is provided in which a smoker can vary the amount of flavorant added to the smoke stream, or select one or more of a number of flavorants. One skilled in the art will appreciate that the present invention can be practiced by other than the embodiments described, which are presented for purposes of illustration and not of limitation, and the present invention is limited only by the claims which follow.

What is claimed is:

1. A filter cigarette, comprising:

a substantially cylindrical tobacco rod;

a substantially cylindrical filter assembly; and tipping paper circumscribing and joining said filter assembly and said tobacco rod; wherein:

said filter assembly comprises:

a first filter assembly segment having a mouth end, a rod end, and a plurality of smoke flow paths therethrough separated by at least substantially smoke-impervious barrier means, at least one of said smoke flow paths containing a smoke flavoring medium;

means abutting said first filter assembly segment and rotatable relative thereto for selectively directing smoke through at least one of said smoke flow paths, and excluding it from the remainder of said smoke flow paths; and means for sealing at least one of said smoke flow paths when smoke is not being directed therethrough, thereby preventing escape of said smoke flavoring medium.

2. The filter cigarette of claim 1 wherein said first filter assembly segment and said abutting relatively rotatable means are retained against axial displacement.

3. The filter cigarette of claim 1 wherein said first filter assembly segment remains stationary relative to said tobacco rod and said abutting relatively rotatable means rotates relative to said tobacco rod.

4. The filter cigarette of claim 1 wherein said first filter assembly segment rotates relative to said tobacco rod and said abutting relatively rotatable means remains stationary relative to said tobacco rod.

5. The filter cigarette of claim 4 wherein said abutting relatively rotatable means is fixed to said tobacco rod.

6. The filter cigarette of claim 4 wherein said abutting relatively rotatable means is fixed to a segment of said filter assembly.

7. The filter cigarette of claim 4 wherein said abutting relatively rotatable means comprises a baffle having at least one opening therein for registry with at least one of said smoke flow paths for the passage of smoke therethrough.

8. The filter cigarette of claim 1 wherein said sealing means comprises a flapper valve.

9. A filter cigarette, comprising:

a substantially cylindrical tobacco rod;

a substantially cylindrical filter assembly; and tipping paper circumscribing and joining said filter assembly and said tobacco rod; wherein:

said filter assembly comprises:

a first filter assembly segment having a mouth end, a rod end, and a plurality of smoke flow paths therethrough separated by at least substantially smoke-impervious barrier means, at least one of said smoke flow paths containing a smoke flavoring medium, and means abutting said first filter assembly segment and rotatable relative thereto for selectively directing smoke through at least one of said smoke flow paths, and excluding it from the remainder of said smoke flow paths;

said first filter assembly segment remains stationary relative to said tobacco rod and said abutting relatively rotatable means rotates relative to said tobacco rod; and said abutting relatively rotatable means comprises a baffle abutting the mouth end of said first filter assembly segment, said baffle having at least one opening therein for registry with at least one of said smoke flow paths for the passage of smoke therethrough.

10. The filter cigarette of claim 9 wherein said abutting relatively rotatable means further comprises a second filter assembly segment having a mouth end and a rod end, said baffle being on the rod end of said second segment.

11. The filter cigarette of claim 10 wherein said second filter assembly segment is a segment of filter tow material.

12. The filter cigarette of claim 11 wherein said segment of filter tow material has a longitudinal bore therein extending from said opening to the mouth end thereof.

* * * * *